United States Patent [19]

Sturm

[11] 4,421,289

[45] Dec. 20, 1983

[54] SHELF SUPPORT

[75] Inventor: William I. Sturm, Niles, Ill.

[73] Assignee: SP Industries, Inc., Chicago, Ill.

[21] Appl. No.: 350,868

[22] Filed: Feb. 22, 1982

[51] Int. Cl.[3] ..... A47G 29/02

[52] U.S. Cl. ..... 248/246; 108/108; 211/193

[58] Field of Search ..... 248/243, 246, 235, 239, 248/241, 245, 247, 250; 108/108; 211/193

[56] References Cited

U.S. PATENT DOCUMENTS

| | | | |
|---|---|---|---|
| 2,703,692 | 3/1955 | Felix . | |
| 3,158,349 | 11/1964 | Bergstrom | 248/243 |
| 3,429,540 | 2/1969 | Worrallo | 248/246 |
| 3,865,337 | 2/1975 | Towfigh | 248/246 |
| 4,103,855 | 8/1978 | Grosse . | |
| 4,156,515 | 5/1979 | Mochly | 108/108 X |
| 4,170,335 | 10/1979 | King | 248/246 |
| 4,174,486 | 11/1979 | Winkler | 248/246 X |
| 4,223,863 | 9/1980 | Birman . | |
| 4,274,614 | 6/1981 | Worrallo . | |
| 4,335,861 | 6/1982 | Klaric | 248/246 |

*Primary Examiner*—J. Franklin Foss

*Attorney, Agent, or Firm*—Neuman, Williams, Anderson & Olson

[57] ABSTRACT

A shelf support is disclosed in which the position of a bracket on an elongated support member is infinitely adjustable and in which a pair of support surfaces on the bracket engage a pair of support surfaces on the support member, one of which is defined by an elongated strip of resiliently deformable material. A lock is provided for holding the bracket in a shelf support position and it includes a resilient pin having ends engaging ribs of a channel-shaped support member.

7 Claims, 6 Drawing Figures

SHELF SUPPORT

This invention relates to shelf supports and more particularly to shelf supports of the type in which shelf support brackets are supported on elongated members which are screwed or otherwise secured to a wall. With the shelf supports of the invention, the vertical position of the brackets is adjustable to the exact level desired and, at the same time, the brackets are securely and reliably held in position. The brackets are readily mounted with minimal effort on the part of the user and the brackets and the support members are readily and economically manufacturable.

BACKGROUND OF THE INVENTION

In a conventional type of shelf support, brackets are provided in the form of plates having projecting portions at a rearward end thereof for locking engagement into slots provided on elongated supports which are screwed or otherwise secured to a wall. This type of shelf support has been generally satisfactory in many cases and has been widely used but has had disadvantages including the fact that the number of obtainable vertical levels of the brackets is limited by the number of slots in the elongated supports. Also, the supports must be carefully installed to insure that the slots therein are all at the same levels since otherwise the shelves may be inclined. When a shelf overlies three or more brackets along its length, there is a possibility that it will be supported by less than all of such brackets if the elongated supports are not accurately mounted.

Proposals have been made for providing infinitely adjustable brackets of various types. The arrangements as proposed have been relatively complicated and have been such that there is a possibility that the shelves will not be securely and reliably supported, especially if the brackets are not carefully installed. They have been such that installation of the brackets is difficult and time-consuming and the brackets and supporting structures have been expensive to manufacture.

SUMMARY OF THE INVENTION

This invention was evolved with the general object of overcoming disadvantages with prior art arrangements and of providing a shelf support in which the position of a shelf support bracket is infinitely adjustable and in which the bracket is securely and reliably locked in position once installed.

Another object of the invention is to provide a shelf support in which the position of a bracket may be easily adjusted and which is such that the bracket can be readily installed.

A further object of the invention is to provide a shelf support in which a bracket may be readily installed and easily adjusted in position to be securely held while at the same time, the bracket and supporting structures are readily and economically manufacturable.

In a shelf support constructed in accordance with the invention, a bracket is supported from an elongated vertically extending support in a manner such that with a downward force on the forward end of the bracket, a torque is developed which presses first and second support portions of the bracket against cooperating first and second support portions of the elongated support. The first support portion of the elongated support may preferably include a rear wall of a generally channel-shaped member having a pair of side walls, the second support portion preferably including a pair of inwardly extending portions on the forward edges of such side walls. The bracket may preferably be in the form of a plate having a lower rearward end portion forming a first support portion for cooperating with the rear wall of the support, a pin being extended through the plate to define a second support portion for cooperation with the rearwardly facing surfaces of the inwardly projecting portions of the channel-shaped member.

An important feature of the shelf support of the invention is that one of the support portions includes a member of a resiliently deformable material for cooperating with another support portion to securely lock the bracket against downward movement when it is in its shelf support position. Preferably, a support portion of a hard material is at least partially embedded in the resiliently deformable material when a normal loading force is applied to the bracket. With these features, the bracket is very securely and reliably held against downward displacement so as to provide a high degree of safety. At the same time, the position of the bracket is infinitely variable and is readily adjustable.

In accordance with specific features, the member of resiliently deformable material is provided on the elongated support and preferably it is in the form of an elongated strip which is mounted in a channel provided in an elongated support member.

Another feature of the shelf support of the invention relates to the provision of a lock arrangement which operates when the bracket is in its shelf support position to firmly press the support portions of the bracket into engagement with the support portions of the elongated support, acting independently of and in addition to any torque developed from the weight of the bracket and any force applied by a shelf thereagainst. This specific feature is highly advantageous in that the bracket may be readily placed in the desired position and then locked in position prior to installation of a shelf to remain in its adjusted position while one or more other brackets are installed. It obviates the possibility of accidental displacement of the bracket during installation of the brackets, or otherwise.

In accordance with a specific feature, the lock means is releasable upon upward pivotal movement of the bracket away from its shelf support position. Preferably, an over-center spring device is provided which is operable to urge the bracket either toward its shelf support position or toward its upper released position. In a preferred embodiment of the invention, the device is in the form of a simple resilient pin extended through a plate portion of the bracket and engaging ribs of a channel-support member which ribs also cooperate with a back wall of a support member to define a channel for a strip of resiliently deformable material.

In one embodiment of a bracket according to the invention, it may support a shelf in a horizontal plane from a vertically extending support member which is at a 90 degree angle to the horizontal. In another embodiment of a bracket according to the invention, it may support a shelf which extends at an angle other than 90 degrees with respect to the wall. This type of bracket is desirable in certain applications.

This invention contemplates other objects, features and advantages which will become more fully apparent from the following detailed description taken in conjunction with the accompanying drawings.

DESCRIPTION OF PREFERRED EMBODIMENTS

Figure 1:
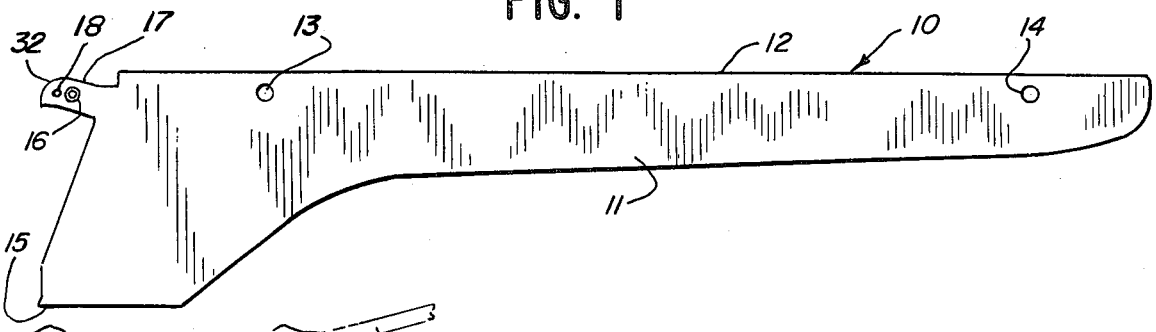
FIG. 1 is side elevational view of a bracket constructed in accordance with the principles of the invention.

Reference numeral 10 generally designates a bracket constructed in accordance with the principles of the invention and including a plate 11 which has an upper edge 12 useable for engaging the underside of and supporting a shelf, not shown. The plate 11 may also be provided with one or more holes such as the holes 13 and 14 as illustrated, for securely locking the shelves in place with associated hardware, such as disclosed in U.S. Pat. No. 3,199,622.

The bracket 10 is arranged to be supported from its rearward end and it includes a pair of support portions for engagement with a cooperating pair of support portions of a vertical support member as hereinafter described. In the illustrated embodiment, one support portion of the bracket 10 is formed by a rearward lower corner portion 15 of the plate 11 and the other support portion thereof is formed by a pin 16 which extends through a rearwardly projecting tab portion 17 of the plate 11 at the upper rearward corner thereof.

The bracket 10 additionally includes a second pin 18 of smaller diameter than the pin 16, extending through the tab portion 17 at a position behind the pin 16. The pin 18 acts as a spring in achieving a locking function in a manner as hereinafter described. Both pins 16 and 18 may preferably be hollow with an axially extending slot formed of spring steel, each pin being compressed when driven into a hole in the plate 11 which has an initial diameter substantially less than the initial diameter of the pin. Thus, the pins are securely and reliably held in the plate 11 and, at the same time, they can be readily installed.

The bracket 10 is designed to be supported from an elongated support which includes a channel-shaped member 20 and an elongated strip positioned in front of a rear wall 22 of the member 20. Strip 21 is of an elastomeric or other resiliently deformable material and may preferably have a cross-sectional shape as shown with side flange portions rearwardly offset with respect to a forward central portion. This shape provides clearance with respect to screw heads and otherwise facilitates insertion of the strip 21.

The member 20 includes a pair of side walls 23 and 24 which project forwardly from the sides of the rear wall 22 and a pair of wall portions 25 and 26 which project inwardly, toward each other, from the forward edges of the side walls 23 and 24. The member 20 additionally includes a pair of longitudinally extending ribs 27 and 28 which extend inwardly from the inner sides of the side walls 23 and 24 in spaced relation to the rear wall 22. The ribs 27 and 28 cooperate with the rearward wall 22 in providing a channel for receiving the resilient strip 21 and the ribs 27 and 28 also are engageable by the ends of the pin 18 to perform a locking function as hereinafter described.

The installation, use, operation and adjustment of the shelf support are relatively simple. The elongated member may be secured to a wall as by extending screws through holes provided in spaced relation along the length of the rear wall 22, two of such holes being illustrated as being designated by reference numerals 29 and 30. When a shelf is to be supported, two or more of the members 20 are secured to the wall in horizontally spaced relation. It is noted that exact positioning of the supports is not critical since the vertical position of brackets is infinitely adjustable.

Figure 2:
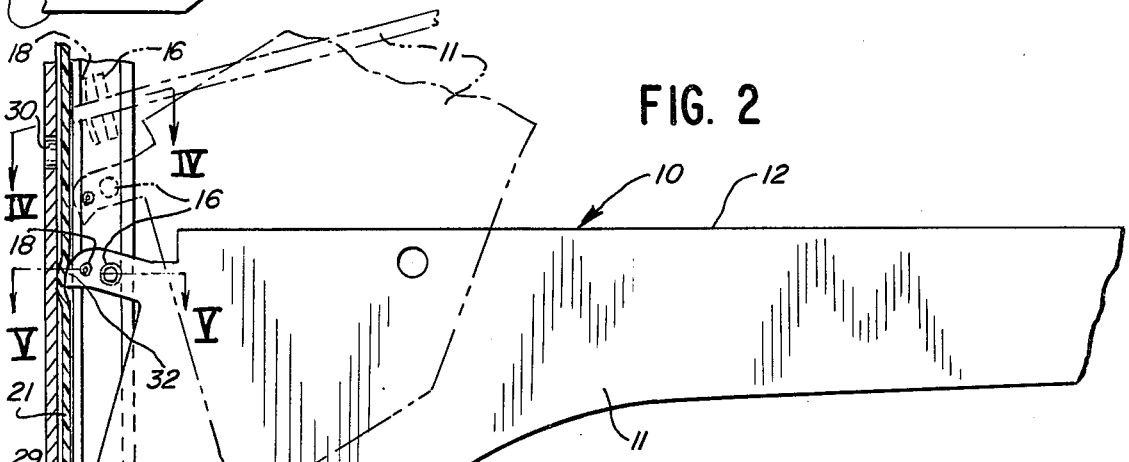
FIG. 2 is an elevational sectional view to a vertical support member according to the invention, showing in full lines the rearward portion of the bracket of FIG. 1 mounted therein, also showing, in dotted lines, a position of the bracket when initially being installed and additionally showing, in broken lines, a released position of the bracket.
Figure 3:
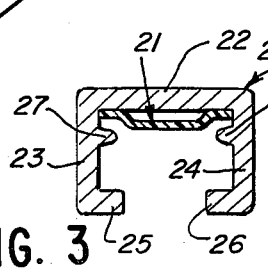
FIG. 3 is a sectional view taken substantially along line III—III of FIG. 2.
Figure 4:
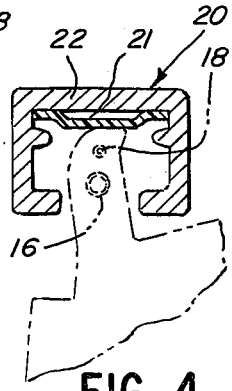
FIG. 4 is a sectional view taken substantially along line IV—IV of FIG. 2, illustrating in dotted lines the position of the bracket when being initially installed.

To install the bracket 10, it is initially held in a position as depicted in dotted lines in the upper part of FIG. 2 and in FIG. 4, the tab portion 17 being inserted through the slot defined by the inner edges of the wall portions 25 and 26. Then the bracket is rotated about a generally horizontal axis to a position as depicted in broken lines in FIG. 2, the ends of the pins 16 and 18 being then positioned behind the rear surfaces of the wall portions 25 and 26 and in front of the ribs 27 and 28.

Figure 5:
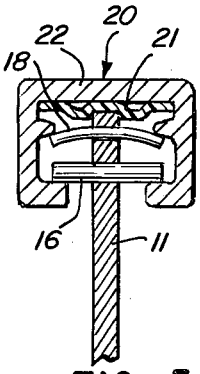
FIG. 5 is a sectional view taken substantially along line V—V of FIG. 2 and showing the condition of portions of the components in a shelf support position of the bracket.

After positioning the bracket as shown in broken lines, it may be moved up or down to approximately the desired vertical position and then the forward end may be moved downwardly to effect rotation about a horizontal axis intersecting of the points of contact between the ends of the pin 16 and the rear surfaces of the wall portions 25 and 26. The bracket 10 is then positioned as shown in full lines in FIG. 2 and it is resiliently held in that position by the operation of the spring pin 18 which is resiliently bent as shown in FIG. 5 with the ends thereof being engaged with the forward sides of the ribs 27 and 28. It is noted that in the position depicted in FIG. 2, the axis of the pin 18 is above a plane through the axis of the pin 16 and at right angles to the plane of the rear wall 22 so that the pin 18 operates to apply a torque in a clockwise direction as depicted in FIG. 2. However, in the broken line position as previously described, the axis of the pin 18 is below such a plane. Thus, in moving from the released position shown in broken lines to the support position shown in full lines, there is an over-center movement of the spring pin 18.

When the bracket 10 is moved to the support position illustrated in full lines in FIG. 2, the rearward lower corner portion 15 of the plate 11 is pressed into the resiliently deformable strip 21, the deformation of the strip 21 being increased in proportion to the loading force applied to the bracket 10 by a shelf or otherwise. With a normal loading force, the corner portion 15 is at least partially embedded in the material of the strip and through the frictional engagement so provided, the bracket 10 is securely and reliably held against vertical movement.

There is also, of course, a frictional engagement between the ends of the pin 16 and the rear surfaces of the wall portions 25 and 26 which opposes vertical movement of the bracket 10. In addition, the rearward end of the tab portion 17 may have a rounded configuration as indicated by reference numeral 32 to cause it to be cammingly pressed into the strip 21 when the bracket 10 is rotated to the support position illustrated in full lines in FIG. 2. The bracket 10 may be readily removed whenever desired, by reversing the procedure used in installing the bracket. Also, the vertical position of any bracket may be readily changed by simply lifting it, then moving it up or down to the extent required and then pushing it back down to the support position.

Figure 6:
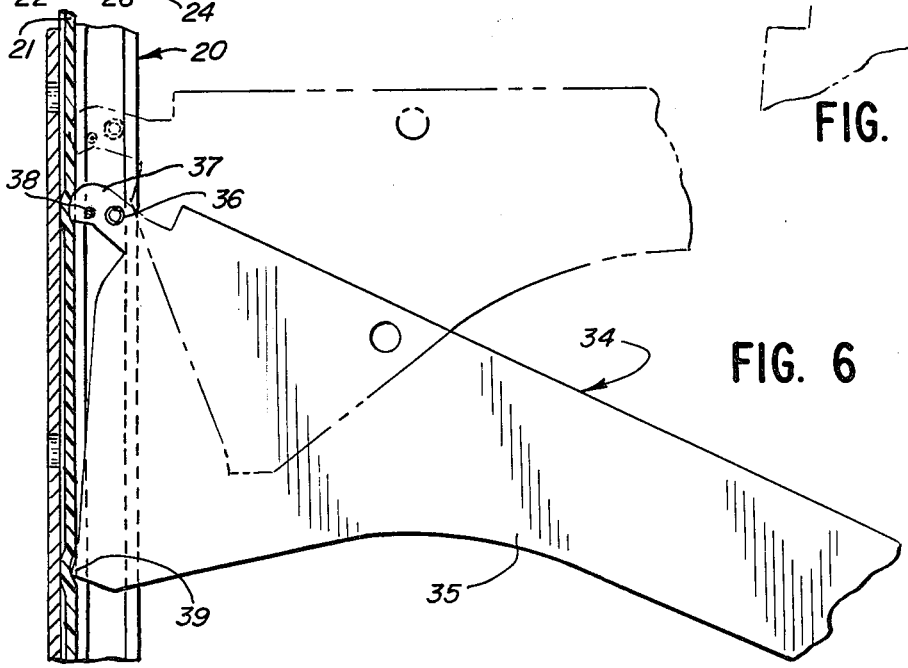
FIG. 6 is a view similar to FIG. 2 but illustrating a modified form of bracket, the rearward portion of which is shown in full lines in a shelf support position and in broken lines in a released position.

The bracket 10 as illustrated in FIGS. 1 and 2 is designed for use in supporting shelves in a horizontal plant at 90 degrees to a vertical wall which is at 90 degrees to the horizontal. FIG. 6 illustrates a modified bracket 34 which is designed for use in supporting shelves in an inclined plane from the wall, such as for use in commercial displays for shoes or the like. The bracket 34 includes a plate 35, a pin 36 supported on a tab portion 37 which also supports a spring pin 38, corresponding to pin 16, tab portion 17 and spring pin 18 and operating in the same manner. The bracket 34 differs from the bracket 10 in that the lower rearward corner portion 39 of the plate 35 is positioned a substantial distance forwardly, as compared with the spatial relationship of the corner portion 15 to the pin 16 in the bracket 10. It will be apparent that other brackets may be provided having differing spatial relationships, as desired.

It will be understood that other modifications and variations may be effected without departing from the spirit and scope of the novel concepts of this invention.

I claim:

1. A shelf support comprising: a bracket for extending generally horizontally and forwardly from a wall to support a shelf or the like and including first and second support portions at a rearward end thereof, an elongated support adapted to be secured to a wall and defining first and second support portions for engagement with said first and second support portions of said bracket when said bracket is in a shelf support position, a downward force on the forward portion of said bracket being then effective to develop a torque in one direction pressing said first support portion of said bracket against said first support portion of said support while pressing said second support portion of said bracket against said second support portion of said support, and lock means operative in response to movement of said bracket to said shelf support position to lock said bracket in said shelf support position, said lock means being operative to develop a torque acting in said one direction on said bracket independently of and in addition to any torque developed from the weight of said bracket and any force applied by a shelf thereagainst to firmly press said first and second support portions of said bracket into engagement with said first and second support portions of said support, said lock means being releasable upon upward pivotal movement of said bracket away from a shelf support position into a release position in which the forward end thereof is positioned upwardly with respect to said rearward end thereof, said lock means being in the form of an over-center spring device operable when said bracket is above a position intermediate said shelf support and release positions to urge said bracket upwardly and operable when said bracket is below said intermediate position to urge said bracket downwardly toward said shelf-support position.

2. A shelf support comprising: a bracket for extending generally horizontally and forwardly from a wall to support a shelf or the like and including first and second support portions at a rearward end thereof, an elongated support adapted to be secured to a wall and defining first and second support portions for engagement with said first and second support portions of said bracket when said bracket is in a shelf support position, a downward force on the forward portion of said bracket being then effective to develop a torque in one direction pressing said first support portion of said bracket against said first support portion of said support while pressing said second support portion of said bracket against said second support portion of said support, and lock means operative in response to movement of said bracket to said shelf support position to lock said bracket in said shelf support position, said lock means including a resilient spring pin carried by said bracket.

3. In a shelf support as defined in claim 2, said elongated support including a pair of surfaces extending along the length thereof and engageable by opposite ends of said spring pin in said shelf support position of said bracket.

4. In a shelf support as defined in claim 1, said lock means including a resilient spring member carried by said bracket and cooperating with said first support portion of said bracket to urge said bracket upwardly when said bracket is above said intermediate position and to urge said bracket downwardly when said bracket is below said intermediate position.

5. In a shelf support as defined in claim 4, said elongated support including a pair of surfaces extending along the length thereof, and said spring member being in the form of a pin mounted transversely on said bracket and having opposite ends engageable with said elongated support.

6. In a shelf support as defined in claim 5, said elongated support including an elongated member having a back wall and a pair of forwardly extending side walls and further including a pair of ribs projecting inwardly from inner surface portions of said side walls to define said pair of surfaces for engagement with opposite ends of said spring member.

7. In a shelf support as defined in claim 6, a strip of resiliently deformable material between said pair of ribs and said back wall and forming one of said first and second support portions of said elongated support.

* * * * *